US006736056B1

(12) United States Patent
Marek

(10) Patent No.: US 6,736,056 B1
(45) Date of Patent: May 18, 2004

(54) MANUAL INK APPLICATOR

(75) Inventor: Kenneth I. Marek, Wauconda, IL (US)

(73) Assignee: A Marek Ken Company, Wauconda, IL (US)

( * ) Notice: Subject to any disclaimer, the term of this patent is extended or adjusted under 35 U.S.C. 154(b) by 0 days.

(21) Appl. No.: 10/303,768

(22) Filed: Nov. 15, 2002

(51) Int. Cl.[7] ..... B41F 15/46; B05C 17/10
(52) U.S. Cl. ..... 101/123; 101/114; 15/245
(58) Field of Search ..... 101/364, 114, 101/123, 124, 129, 120, 167, 169; 15/245, 245.1, 236.01; 118/413

(56) References Cited

U.S. PATENT DOCUMENTS 4,888,846 A * 12/1989 Natale ..... 15/236.01
5,078,062 A * 1/1992 Mraz ..... 101/123
5,455,981 A * 10/1995 Wiese ..... 15/236.01
5,503,067 A 4/1996 Jaffa
6,142,070 A * 11/2000 Hoffman, Jr. et al. ..... 101/123

* cited by examiner

*Primary Examiner*—Leslie J. Evanisko
(74) *Attorney, Agent, or Firm*—Knechtel, Demeur, & Samlan

(57) ABSTRACT

A manual ink applicator for use in screen printing which uses a squeegee that is mounted on a pair of pivoting links. The links in turn are mounted on a pair of shuttle blocks. The pivoting links raise the squeegee from the screen surface when the shuttle blocks make contact with the top and bottom ends of the screen frame or adjustable stops mounted to the sides of the screen frame, and the operator continues in the same direction as the squeegee was moving just prior to the blocks making said contact. The operator then changes the direction of movement of the squeegee. There is a handle and a brace attached to the shaft. The user places his or her arm through the brace and grasps the handle. By applying the force to the squeegee through the handle, brace and shaft, the force to the squeegee is substantially greater than if just applied to the squeegee by the user's hands. This minimizes user fatigue and allows a greater and more uniform force to be applied to the squeegee than by previous manual devices.

17 Claims, 7 Drawing Sheets

MANUAL INK APPLICATOR

BACKGROUND OF THE INVENTION

This invention relates to manual hand tools and more particularly to manual ink applicators commonly used in screen printing.

Clothing such as T-shirts, sweatshirts and the like commonly have images and printing placed on the article by a process called screen printing. Generally the process is done manually or automatically on screen printing machines. In either the manual or automatic process there is a screen firmly held slightly above the article of clothing. A flood bar is placed in contact with the screen and passed over the screen, spreading ink over the screen surface. Next a print squeegee is moved across the surface of the screen and a downward pressure is applied, which forces printing ink through the screen and onto the material that is to receive the image.

The manual screen printing process has some advantages over the automatic printers. They are relatively inexpensive to purchase and operate. They are also energy and space efficient. The manual process is particularly well suited for small runs and test runs prior to setting up the automatic machines.

However, there are several problems that arise when using manual printing machines that are not present when using an automatic machine. First, the manual printing machines operate slowly. One reason is that the squeegee requires a substantial amount of pressure applied to it to force the ink through the screen. The operator must flood the ink consistently and then apply adequate pressure to print an article. In order to get the density, opacity or finish desired, and depending on the pressure applied, it may require multiple passes of the squeegee. Further many plastisol ink colors have a high tack level and require considerable force to transfer the ink cleanly through the mesh of the screen. Second, when applying high-density inks, the same problems as stated above are present and a sufficiently high and constant pressure is required for clean printing. A substantial force is required to be applied to the squeegee throughout the printing stroke. Most operators cannot withstand this effort for making multiple prints as fatigue sets in. The results of manual screen printing using a conventional squeegee are inconsistency and diminishing productivity. Furthermore, job related injuries such as carpal tunnel syndrome often result.

SUMMARY OF THE INVENTION

Applicant's invention provides a manual tool that applies the required force necessary to print with today's inks. The tool transfers the force from the user's arm and body to the squeegee instead of applying the force from the user's wrists and fingers to the squeegee. Thus, greater force can be applied to the squeegee and fatigue to the user's wrists, hands and fingers is minimized.

Applicant's device has a pair of opposed shuttle blocks positioned on either side of the screen printing apparatus. Each shuttle block has a pivoting bracket mounted on it. A squeegee is mounted between and to the pivoting brackets. There is a shaft having one end connected to the squeegee holder. Near the other end of the shaft is a brace through which the user places his or her arm. The user grasps a handle on the shaft so that when the user grasps the handle and the brace encompasses the user's arm, the shaft and the user's arm are aligned. The user applies a force to the squeegee through the handle and shaft for spreading the ink and for printing. In a first position, the pivoting bracket and squeegee assume an orientation to spread or flood the ink on the screen and in a second position in which the brackets are pivoted, the squeegee assumes an orientation for printing. The apparatus allows the user to apply greater forces with ease to the screen for printing, which minimizes fatigue and improves printing.

OBJECTS AND ADVANTAGES

Thus it is an object of the invention to provide a manual ink applicator that allows the user to apply greater forces to the squeegee than have previously been applied using the user's hand and fingers.

Another object is to provide a manual ink applicator that places the squeegee in a first orientation to spread or flood the ink across the screen when moved in a first direction and places the squeegee in a second orientation to print when moved in the opposite direction. Related to this object is the object of mounting the squeegee on a pivoting bracket arrangement that allows the squeegee to move from the first orientation to the second orientation by means of the pivoting bracket.

Still another object is the object of providing a manual ink applicator for screen printing in which the force from the user is transferred to the squeegee through the applicator without the user grasping the squeegee by the user's hands to apply the printing force. A related object is the object of providing a manual ink applicator in which the applicator has a handle that is grasped by the user and a brace that encompasses the user's arm to align the applicator with the user's arm. An advantage of this apparatus is to efficiently transfer the force from the user to the squeegee.

Yet another object is to provide a squeegee that operates as a flood bar in one direction and a pressure applying squeegee in the other direction and in which the squeegee is raised above the screen when changing directions so that it is raised up and passes over the ink when changing directions.

These and other objects and advantages will be apparent from reading the Description of the Drawings and Description of the Preferred Embodiment.

DESCRIPTION OF THE PREFERRED EMBODIMENT

Figure 1:
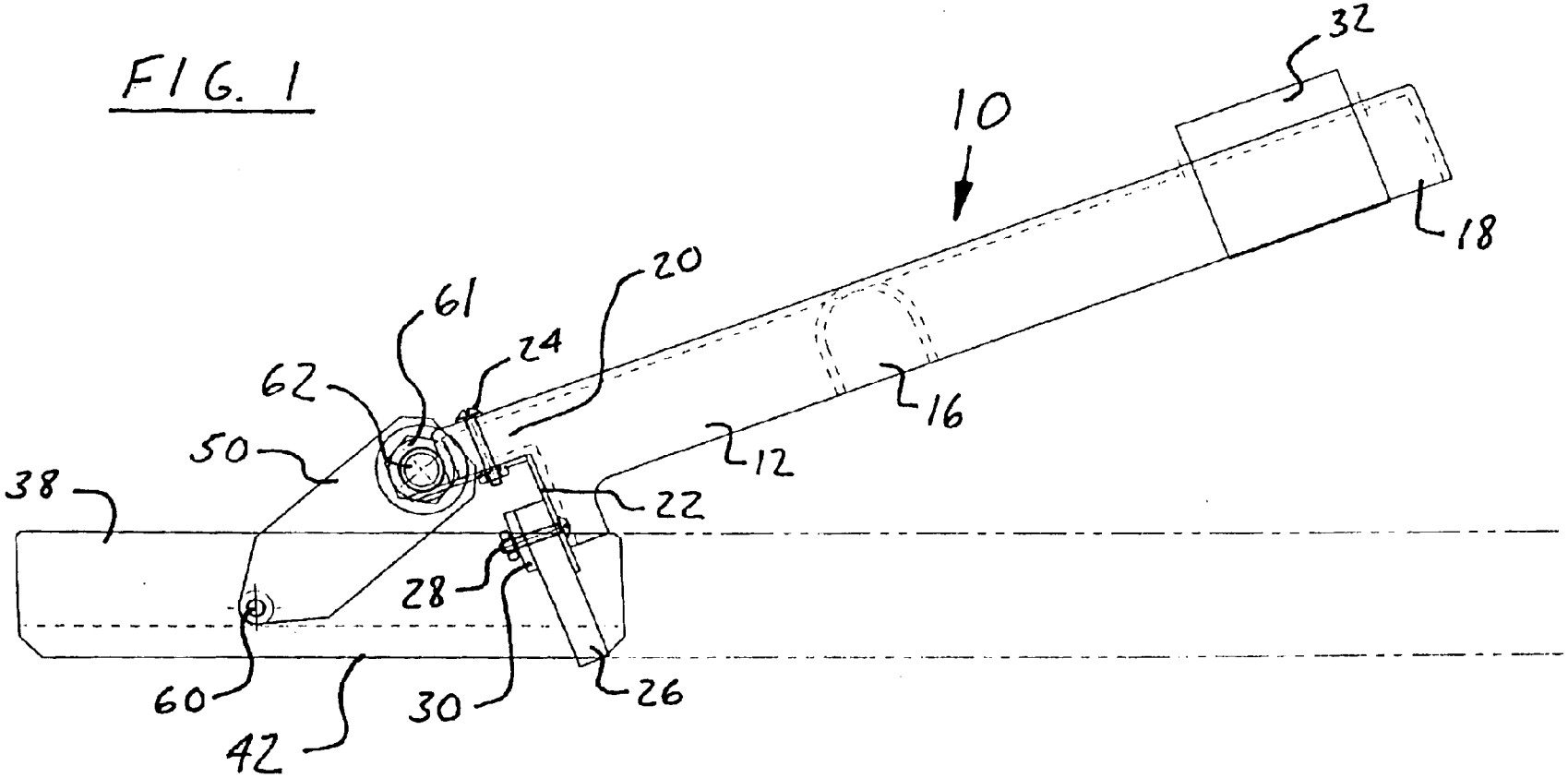
FIG. 1 is a left side elevation view of the manual ink applicator.
Figure 2:
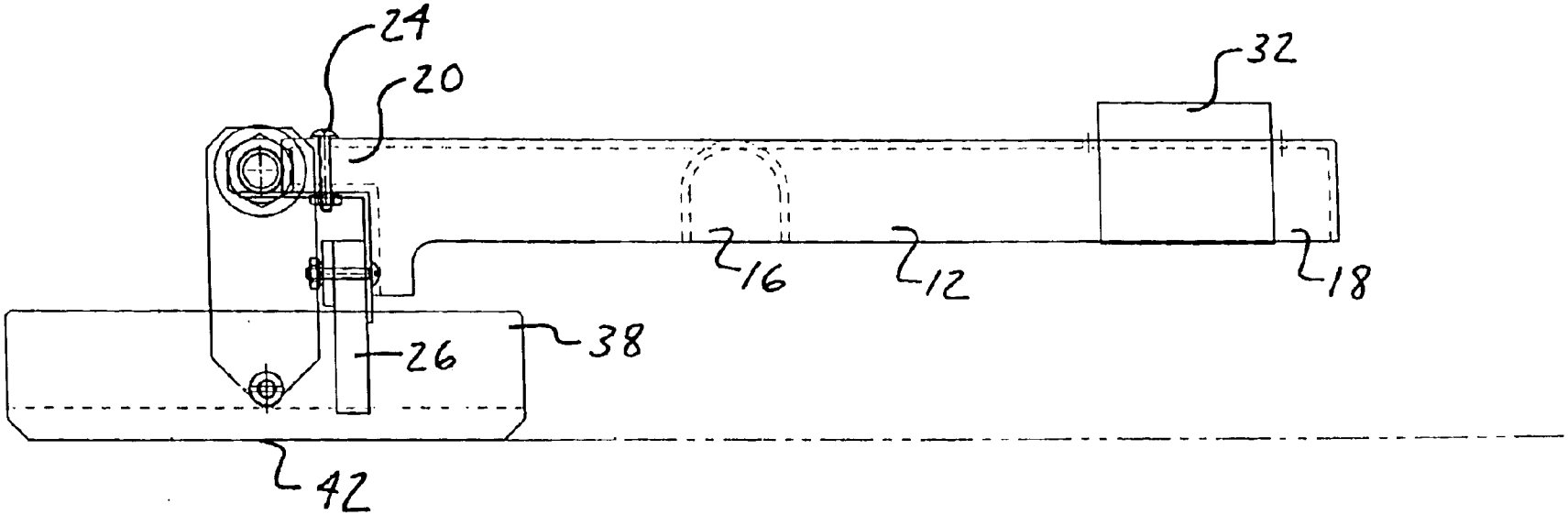
FIG. 2 is a left side elevation view of the manual ink applicator mid way position between the first and second operating positions.

Turning to FIG. 1 there is illustrated a manual ink applicator 10 of the present invention. There is at least one shaft, illustrated as a first shaft 12, and additionally preferred a second shaft 14. The shafts 12 and 14 are parallel to each other and are joined by a handle 16. The shafts and handle may be joined together by conventional means, such as conventional fasteners or adhesives, or can be integrally molded together of plastic. The shafts 12 and 14 have proximal ends 18 and distal ends 20.

Mounted to the distal ends 20 is a support member 22 or support bracket 22 that is generally L-shaped to aid in securely mounting it to the distal end 20. Screws or other conventional fasteners 24 are used to attach one arm of the L-shaped support member 22 to the distal end 20 of the shafts 12 and 14. A squeegee 26 of conventional design is attached to the other arm of the support bracket 22 by means of fasteners 28, which pass through a support plate 30. The squeegee 26 is made of flexible rubber-like material and is used to flood the ink over the screen when moved in a first direction and to print the image when the squeegee is moved in a second direction opposite the first direction.

Figure 6:
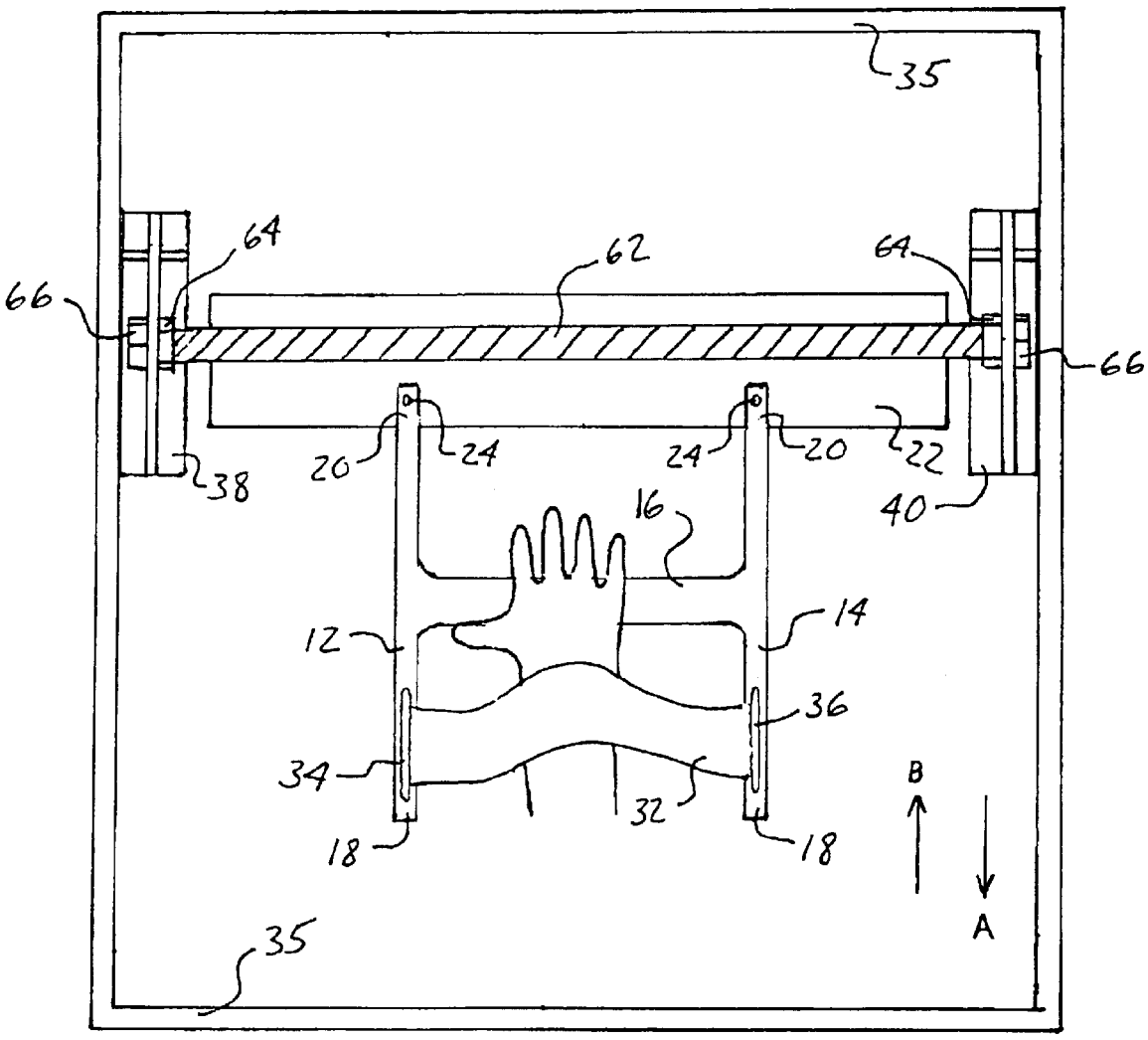
FIG. 6 is a top view of the ink applicator showing the user's arm inserted through the adjustable strap and the operator's hand grasping the handle.

At the proximal end 18 of the shafts 12 and 14 is an arm brace 32. As shown, the brace 32 is an adjustable flexible strap that has one end passing through a slot 34 in the proximal end of the first shaft 12. The other end of the flexible strap passes through a second slot 36 in the proximal end 18 of the second shaft 14 (FIG. 6). Using conventional means, the length of the strap can be adjusted to snugly accommodate the user's arm in a loop formed in the adjustable strap. The brace 32 can be made of other materials, both flexible and rigid. However, it is designed to snugly receive the user's arm when the user's hand grasps the handle 16 as seen in FIG. 6. In this manner, the user's arm becomes aligned with, and connected by means of the arm brace 32 to, the shafts 12 and 14 when grasping the handle 16. Furthermore, by adjusting the length of the strap, the angle of the squeegee with respect to the screen is changed. This changes the printing characteristics, which depend on the skill of the operator to achieve the desired printing results.

A screen is placed above the material or object on which the image is to be applied. As seen in FIG. 6, the screen has a screen frame 35 that borders the area in which the screen printing takes place. The frame 35 is securely held in place during the printing process. Generally the image area has a layer of ink applied over the area, which is called flooding. The squeegee 26 spreads the ink evenly over the image area by moving in a first direction over the image area and applying a light pressure to the screen, which is not sufficient to cause the screen to contact the material on which the image is to be applied. Then the squeegee is moved in a second direction, opposite the first direction and with a greater pressure, pushes the screen in contact with the material, and forces the ink through the screen onto the material where the image is printed. The printing cycle comprises both a flooding and printing stroke. In the preferred embodiment as seen in FIG. 6, the flooding takes place when the squeegee 26 is pulled toward the user which is in the direction of arrow A. The printing takes place when the squeegee is pushed away from the user in the direction of arrow B. However, the reverse directions can also be used for flooding and printing. The important point is that the printing takes place when the squeegee 26 applies sufficient pressure to the ink to force it through the screen and onto the image receiving surface.

Figure 10:
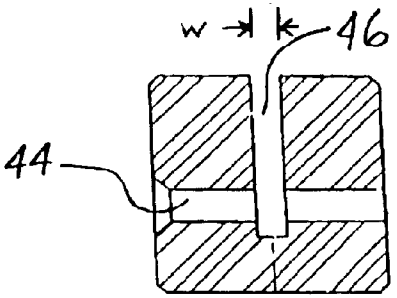
FIG. 10 is an end view of the shuttle block of FIG. 8.
Figure 8:
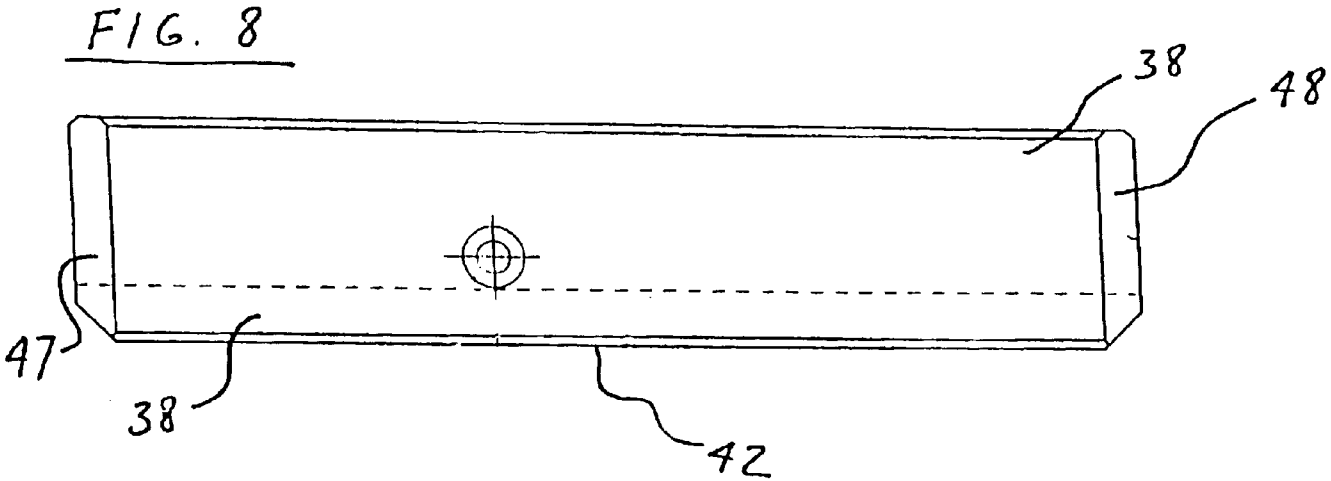
FIG. 8 is a side elevation view of the shuttle block.
Figure 9:
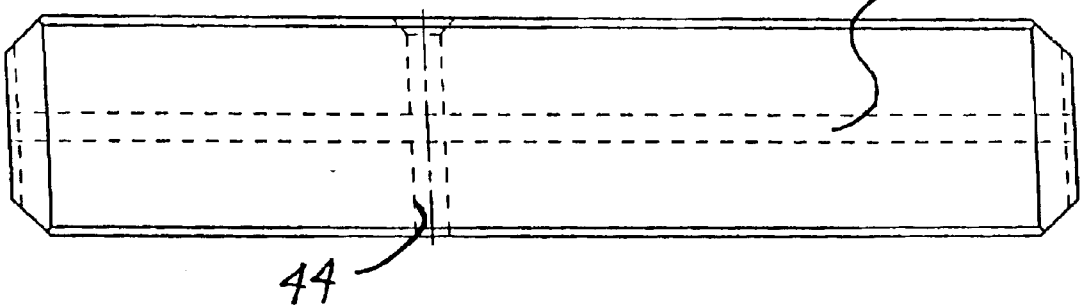
FIG. 9 is a top plan view of the shuttle block of FIG. 8.

As seen in FIG. 6, the ink applicator 10 has a first shuttle block or ski 38 positioned next to the frame 35. Opposite the first shuttle block 38 is a second shuttle block or ski 40. The construction of the shuttle blocks 38 and 40 is illustrated in FIGS. 8–10. The shuttle blocks 38 and 40 are preferably made of nylon or plastic and have a smooth bottom surface 42 that easily slides over the screen. There is an axial passageway 44 that extends through the shuttle block from one side to the other. There also is a longitudinal groove 46 that is cut from the top of the shuttle block 38 to below the axial passageway 44. The longitudinal groove 46 extends from a forward end 47 to a trailing end 48 of the shuttle block 38. The longitudinal groove 46 has a width "w" as seen in FIGS. 9 and 10.

Figure 3:
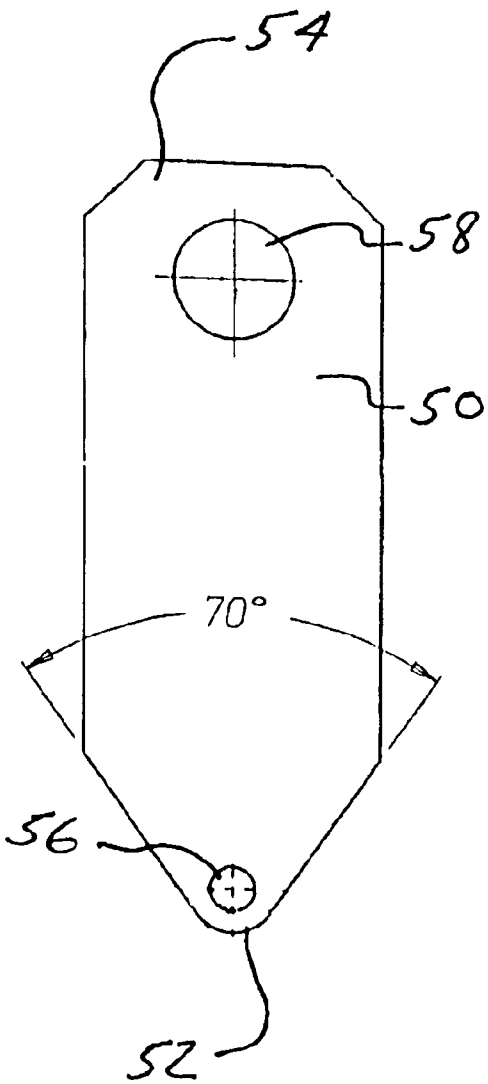
FIG. 3 is a front elevation view of the pivot bracket.
Figure 4:
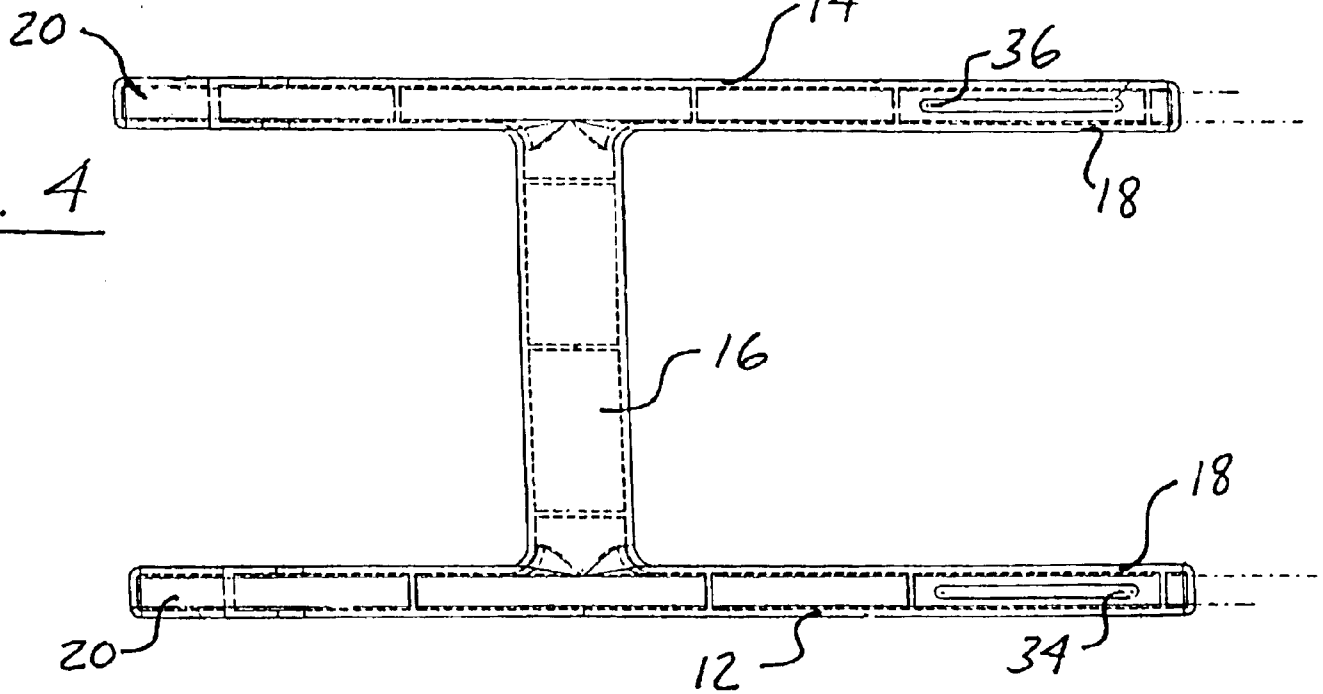
FIG. 4 is a top plan view of the ink applicator handle and shafts with the squeegee and pivot brackets removed.
Figure 5:
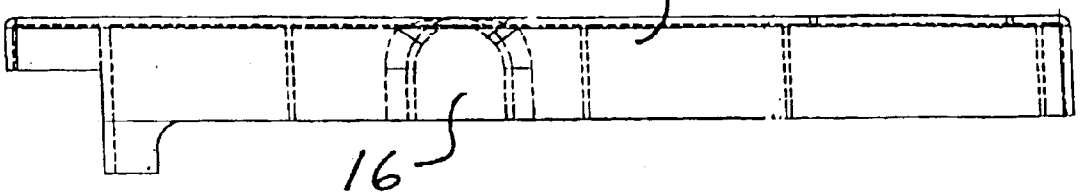
FIG. 5 is left side elevation view of the applicator shown in FIG. 4.

A pivot bracket 50 is attached to each of the shuttle blocks 38, 40. The construction of the pivot bracket is best illustrated in FIG. 3. The pivot bracket 50 has a bottom end 52 and a top end 54. There is a pivot shaft opening 56 passing through the bottom end 52 and a threaded rod opening 58 passing through the top end 54. A fastener 60 such as a nut and bolt connects the bottom end 52 of the pivot bracket 50 to the shuttle blocks 38 and 40. The fastener 60 passes through the axial passageway 44 and the pivot shaft opening 56, thus connecting the pivot bracket 50 to its respective shuttle block 38 or 40. The fastener 60 freely passes through the pivot shaft opening 56 so that the pivot bracket 50 easily pivots about the fastener 60. The thickness of the pivot bracket 50 is slightly less than the width "w" of the longitudinal groove 46 so that the pivot bracket 50 can easily pivot about the fastener 60 and within the longitudinal groove 46.

As most clearly seen in FIGS. 1 and 6, the support member 22 is connected to and between the opposed pivot brackets 50. There is a tube or sleeve 61 that is welded or otherwise affixed to one of the arms of the support holder 22. A threaded shaft or rod 62 passes through the tube 61 and has its opposed threaded rod ends passing through the threaded rod openings 58 in each of the pivot brackets 50. The ends of the threaded rod 62 are attached to the pivot brackets 50 by an interior nut 64, an end nut 66, and optionally a washer 68. The nuts 64 and 66 are tightened against the pivot bracket 50 sufficiently to keep the brackets 50 securely attached to the threaded rod 62. In this manner as the brackets 50 rotate about fastener 60, the threaded shaft 62 rotates within the tube 61 causing the support member 22 to move between the flooding and printing positions as will be more fully described below. In an alternate embodiment the threaded shaft 62 can be firmly connected to the arm of the support member 22 and the ends of the threaded shaft are connected to the brackets 50 in a manner that allows the ends to freely rotate within the threaded rod openings 58. The nuts 64 and 66 are loosely secured on either side of the brackets 50 to insure free sliding of the bracket 50 between the nuts 64 and 66.

In either embodiment the top end 54 of the pivot bracket 50 freely pivots about the threaded shaft 62. The distance between the shuttle blocks 38 and 40 can be adjusted by means of the nuts 64 and 66 moving on the threaded shaft 62. In this manner, the shuttle blocks 38 and 40 can be positioned and maintained adjacent to the sides of the frame 35. The threaded rod 62 is secured to same arm of the support member 22 that the distal ends 20 of the first and second shafts 12, 14 are connected to. The threaded rod 62 can be attached in any of numerous conventional manners such as using fasteners or welding. The particular method of attachment is not critical, only that the relative mounting of the shaft 62 to the arm of the support holder 22 remains connected so that when the threaded shaft 62 moves, it moves in unison with the pivot bracket 50.

Figure 7:
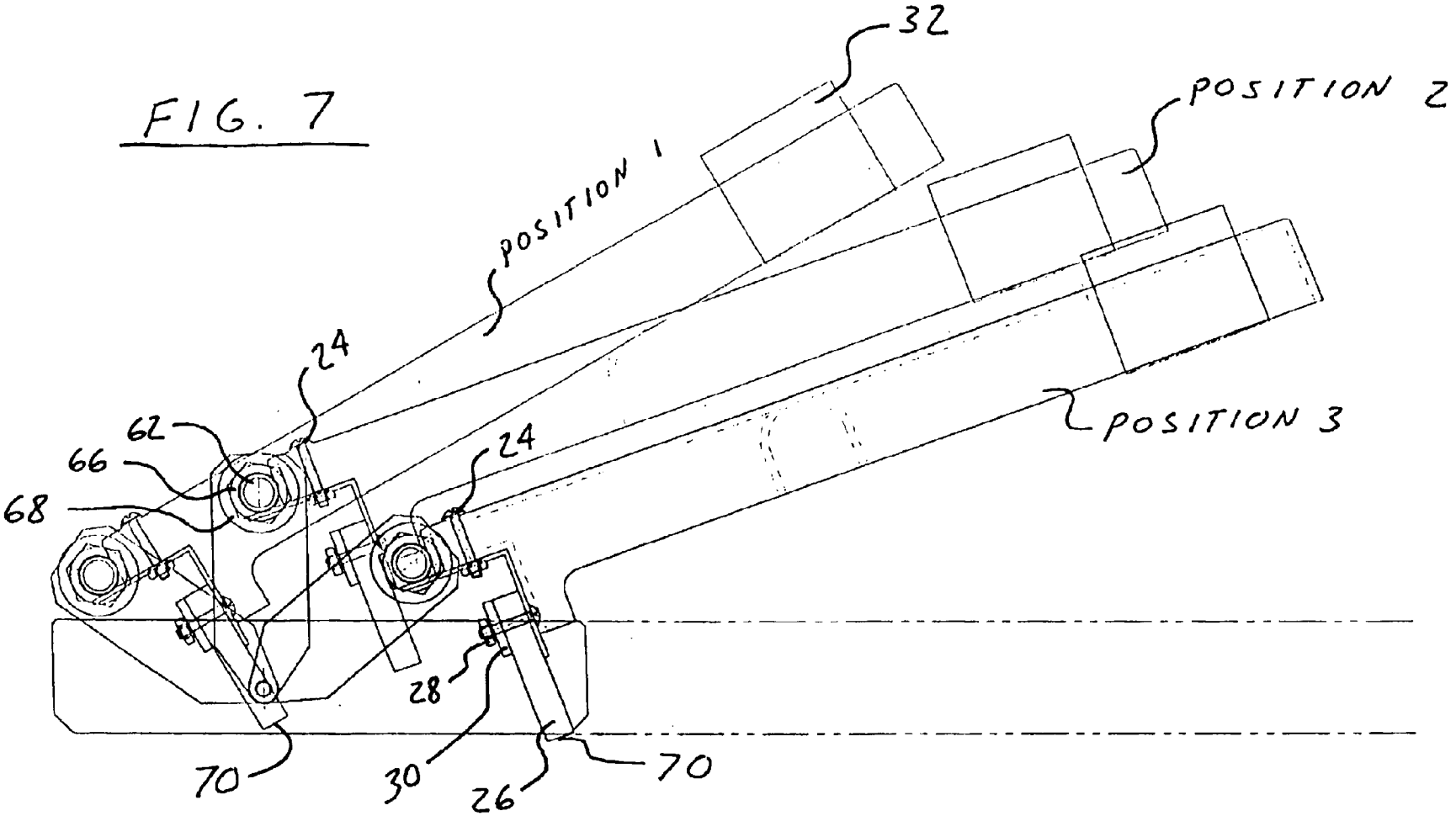
FIG. 7 is a self side elevation view of the ink applicator in three positions, the first position being the ink spreading or flooding position, the second position being an intermediate position, and the third position being the printing position.

In order to use the manual ink applicator 10, the material to which the image is to be applied is securely held in place in the screen printing apparatus. The screen frame 35 is also secured above the material. The applicator 10 is set over the screen and the shuttle blocks 38 and 40 are positioned adjacent to the sides of the frame 35. The user places his or her arm through the arm brace 32 and grasps the handle 16 with his or her hand. The user adjusts the arm brace 32 so that the desired angle of the squeegee is achieved and the user's arm is aligned with the shaft. The applicator 10 and the shuttle blocks 38 and 40 are pushed forward away from the user until they strike the forward edge of the frame 35. The user verifies that the brackets 50 and the squeegee 26 are in a forward position, illustrated as Position 1 in FIG. 7. In Position 1 the bracket 50 is pivoted forward about the fastener 60. A bottom edge 70 of the squeegee 26 is disposed just above or slightly contacting the screen. Ink is applied to the screen in the conventional manner. The user pulls the handle 16 towards the user and applies slight pressure to the handle so that the bottom edge 70 of the squeegee remains above or in light contact with the screen. The ink is thus spread over the screen.

Once the squeegee 26 is drawn back as far as it can go, which is determined by the shuttle blocks 38 and 40 engaging the bottom edge of the frame 35 or stops (not illustrated) on the frames sides, the user pulls up on the handle 16 and pivots the pivot bracket about the fastener 60. The ink applicator 10 moves into an intermediary position as illustrated in Position 2 in FIG. 7. The bracket 50 is substantially upright and the top end 54 is pivoting about the threaded shaft 62. The user continues moving the handle 16 and the shafts 14 and 16 toward the user to the position shown as Position 3. The bottom edge 70 of the squeegee 26 is now resting upon the surface of the screen.

The user's wrist and forearm are now oriented in-line with the handle 16 and the first and second shafts 12 and 14. The user applies a printing force from the upper body to the arm, forearm and wrist. The applied force is transferred through the brace 32 and the handle 16 to the first and second shafts 12 and 14, to support member 22 and then to the squeegee 26. At the same time the user pushes against the handle 16 in a forward direction away from the user, to move the ink applicator 10. The printing force is easily and consistently applied from edge to edge across the squeegee 26. The force is much greater than the force that the user can apply by just using his or her wrist and fingers against the squeegee 26. The ink is forced through the screen onto the image receiving material. When the shuttle blocks 38 and 40 reach the forward or top of the frame 35, or stops on the side of the frame, continued forward movement on the squeegee 26 and the handle 16 raises the handle 16 and causes it to pivot the pivot brackets 50 and the squeegee 26 from Position 3, through Position 2, and into Position 1. The cycle is ready to be repeated as necessary to complete the printing process until the final image is printed onto the receiving medium.

When the squeegee 26 changes direction at the top end bottom of the frame 35, the squeegee 26 is lifted up and out of contact with the screen. The squeegee is removed from contact with the ink on the screen surface and "jumps over" the ink so that the ink remains ahead of the squeegee regardless if the squeegee is in the flooding or printing stroke.

Utilizing the manual ink applicator 10 of the present invention allows the user to apply increased printing pressures over those manual systems in the past. The pressure is applied evenly and consistently across the squeegee 26. User fatigue in the hands, wrist and arm is minimized or eliminated. All types of inks, even those which were difficult to apply with manual printing processes, can be applied with the applicator 10. The materials used to manufacture the applicator 10 are inexpensive and long lasting. The applicator 10 is relatively simple to manufacture due to the relatively few number of moving parts.

Thus there has been provided a manual ink applicator for printing that fully satisfies the objects set forth above. While the invention has been described in conjunction with a specific embodiment, it is evident that many alternatives, modification and variations will be apparent to those skilled in the art in light of the foregoing description. Accordingly, it is intended to embrace all such alternatives, modification and variations as fall within the spirit and scope of the appended claims.

What is claimed is:

1. A manual ink applicator for printing on a printing surface comprising:

a pair of opposed shuttle blocks;

first and second pivot brackets each having opposite first and second ends, the first pivot bracket pivotally connected at its first end to one of the shuttle blocks and the second pivot bracket pivotally connected at its first end to the other shuttle block;

a squeegee having first and second ends, the first and second ends of said squeegee connected to the second ends of the first and second pivot brackets respectively;

a shaft having a proximal end and a distal end, the squeegee attached to the shaft adjacent to the distal end;

a handle attached to the shaft;

a brace attached to the shaft near the proximal end of the shaft, the brace causing a user's arm to align with the shaft when the user's arm engages the brace and the user grasps the handle the pivot brackets and squeegee assuming a first position when the user pulls the handle in a first direction and the pivot brackets and squeegee assuming a second position pivoted from the first position when the user pushes the handle in a second direction opposite the first direction.

2. The manual ink applicator of claim 1 wherein the brace is comprised of flexible material.

3. The manual ink applicator of claim 1 and further comprising a second shaft in spaced parallel relationship with the first shaft and the handle connecting the first and second shafts.

4. The manual ink applicator of claim 1 wherein the squeegee is mounted between the shuttle blocks and maintains the shuttle blocks in spaced parallel relationship to each other.

5. The manual ink applicator of claim 1 wherein the squeegee is made of soft, flexible rubber material.

6. The manual ink applicator of claim 1 wherein the first and second pivot brackets have a height sufficient to raise the squeegee above and out of contact with the printing surface when pivoted between the first and second operative positions.

7. The manual ink applicator of claim 1 wherein the brace is adjustable and provides an adjustment means for the angle of the squeegee with respect to the printing surface.

8. A manual ink applicator for printing through a screen comprising:

a shaft having proximal and distal ends;

a handle attached to the shaft;

a brace attached to the shaft near the proximal end of the shaft, the brace aligning a user's arm with the shaft when the user's arm engages the brace and the user grasps the handle;

a squeegee having first and second opposite ends, the squeegee attached to the shaft adjacent to the distal end, the squeegee in normal contact with the screen during printing;

a first and a second shuttle block connected to the first and second opposite ends of the squeegee respectively;

pivot means to pivot the squeegee between first and second operative positions, the first operative position being an ink flooding position and the second operative position being a printing position, the user selectively moving the squeegee between the first and second operative positions by the application of a force to the shaft, the pivot means operatively connected to the shaft for raising the squeegee above the screen when pivoted between the first and second operative positions.

9. The manual ink applicator of claim 8 wherein the pivot means comprises first and second links connected to the first and second shuttle blocks respectively.

10. The manual ink applicator of claim 9 wherein the first and second links have top and bottom ends, the bottom end of the first link connected to the first shuttle block and the top end of the first link connected to the squeegee's first end, and the bottom end of the second link connected to the second shuttle block and the top end of the second link connected to the squeegee's second end, the distance between the links top and bottom ends being sufficient to raise the squeegee above the screen when pivoted between the first and second operative positions such that the squeegee is raised above the screen and out of contact with the screen when moving between the first and second operative positions.

11. The manual ink applicator of claim 10 wherein the bottom ends of the first and second links are connected to their respective shuttle blocks by means of pivot connections.

12. The manual ink applicator of claim 9 and further comprising adjustment means connected to the first and second opposed shuttle blocks for adjusting the distance between the shuttle blocks to accommodate the size of the screen.

13. The manual ink applicator of claim 12 wherein the adjustment means comprises a threaded shaft extending between the links and fasteners mounted on the shaft, the fasteners engaging the links when the fasteners are rotated, thereby moving the links with respective to each other.

14. The manual ink applicator of claim 13 wherein the first and second links have top and bottom ends, the bottom end of the first link connected to the first shuttle block and the top end of the first link connected to one end of the threaded shaft, and the bottom end of the second link connected to the second shuttle block and the top end of the second link connected to the other end of the threaded shaft, the distance between the links top and bottom ends being sufficient to raise the squeegee above the screen when pivoted between the first and second operative positions such that the squeegee is raised above the screen and out of contact with the screen when moving between the first and second operative positions.

15. The manual ink applicator of claim 8 and further comprising a second shaft having a proximal end and a distal end, the second shaft being substantially parallel to the first shaft, the handle connected to the first and second shafts, and the brace attached to the first and second shafts near their proximal ends.

16. The manual ink applicator of claim 8 wherein the brace is comprised of flexible material.

17. The manual ink applicator of claim 8 wherein the brace is adjustable and provides an adjustment means for the angle of the squeegee with respect to the screen.

* * * * *